United States Patent [19]

Thümmler et al.

[11] Patent Number: 4,913,739

[45] Date of Patent: Apr. 3, 1990

[54] METHOD FOR POWDER METALLURGICAL PRODUCTION OF STRUCTURAL PARTS OF GREAT STRENGTH AND HARDNESS FROM SI-MN OR SI-MN-C ALLOYED STEELS

[75] Inventors: Fritz Thümmler, Karlsruhe; Aloisio N. Klein, Leopoldshafen; Rainer Oberacker, Liedolsheim, all of Fed. Rep. of Germany

[73] Assignee: Kernforschungszentrum Karlsruhe GmbH, Fed. Rep. of Germany

[21] Appl. No.: 292,442

[22] Filed: Mar. 8, 1985

Related U.S. Application Data

[63] Continuation of Ser. No. 498,002, May 23, 1983, abandoned.

[30] Foreign Application Priority Data

Nov. 18, 1982 [EP] European Pat. Off. ..... 82/110622.6
Nov. 18, 1982 [DE] Fed. Rep. of Germany ..... 3219324

[51] Int. Cl.[4] ..... C22C 29/00

[52] U.S. Cl. ..... 75/243; 75/246; 419/11; 419/29; 419/53; 419/54; 419/57; 419/58

[58] Field of Search ..... 419/11, 29, 53, 54, 419/57, 58; 75/243, 246

[56] References Cited

U.S. PATENT DOCUMENTS 4,011,108 3/1977 Hellman et al. ..... 75/226
4,035,159 7/1977 Hashimoto et al. ..... 75/246
4,043,807 8/1977 Kirman ..... 75/123 N
4,058,414 11/1977 Matsuoka ..... 75/123 N
4,265,660 5/1981 Giflo ..... 75/123 L
4,338,128 7/1982 Farge et al. ..... 75/123 L
4,504,312 3/1985 Oaku et al. ..... 75/246

OTHER PUBLICATIONS

Goetzel, *Treatise on Powder Metallurgy,* vol. 1, pp. 204–207, 1949.

Hoffman et al., "Sintering, Homogenization and Properties of Alpha-Phase Iron-Aluminum and Iron-Silicon Alloys", Powder Metallurgy, 3rd Europ. Powd. Met. Symp., 1971, Conf. Supplement, Pt. 1, pp. 335–361.

Lenel, Powder Metallurgy, Principles and Applications, Chapter 17, "Structural Parts" (1980), pp. 401–423.

*Primary Examiner*—Stephen J. Lechert, Jr.
*Attorney, Agent, or Firm*—Sughrue, Mion, Zinn, Macpeak & Seas

[57] ABSTRACT

A process for the powder metallurgical production of structural parts of high strength and hardness from silicon-manganese or silicon-manganese-carbon alloyed steels. The alloying elements Si and Mn or Si, Mn and C are mixed, in powder form, by way of the alloy carriers ferrosilicon, ferromanganese or a silicon-manganese-iron master alloy containing silicon and manganese in the ranges from 10 to 30 weight percent Si, 20 to 70 weight percent Mn, remainder Fe, with an iron powder and when carbon is present with graphite, to form a powder mixture. The powder mixture is compressed and sintered at a temperature in a range from 1150° C. to 1250° C. and then cooled.

7 Claims, 4 Drawing Sheets

METHOD FOR POWDER METALLURGICAL PRODUCTION OF STRUCTURAL PARTS OF GREAT STRENGTH AND HARDNESS FROM SI-MN OR SI-MN-C ALLOYED STEELS

This is a continuation of application Ser. No. 06/498,002, filed May 23rd, 1983 abandoned.

BACKGROUND OF THE INVENTION

The present invention relates to a method for the powder metallurgical production of structural parts of great strength and hardness from silicon-manganese or silicon manganese-carbon alloyed steels.

Since the strength of unalloyed sintered iron is relatively low (even with the greatest density, only about 300 MPa are realized), higher strength requirements can be met only with alloying type measures.

The elements Cu, Ni, Mo, P and C are primarily used as alloying elements. A whole number of alloying elements used in melting metallurgy can be used only conditionally in powder metallurgy. These are alloying elements such as Cr, Mn, Si and Ti, which have high affinity for oxygen, and of which Si and Mn are of particular interest because of their favorable price and their long-term assured availability.

Si is known as a solid solution hardener having a great strengthening effect. In powder metallurgically produced Fe-based alloys, Si is also able to produce considerable increases in strength. See, Hoffman, G. Thummler, F., Zapf, G., 37 Sintering, Homogenization and Properties of Alpha-Phase Iron-Aluminum and Iron-Silicon Alloys", Powder Metallurgy, 3rd Europ. Powd. Met. Symp. 1971, Conf. Supplement, Pt. 1, pages 335–361. However, there are two drawbacks. Firstly, due to its high oxygen affinity, Si tends to form oxides in industrial sintering atmospheres. This could be countered by using an Fe-Si master alloy as the alloy carrier. See German Published Patent Application No. 1,928,930, entitled "Method for Producing Sintered Materials on an Iron Base". However, sintered steels produced according to this method are unsuitable for structural parts since intensive shrinkage occurs during the sintering process which has a negative effect on the bodies' retention of dimensions. Experiments have been made to compensate for the shrinkage by alloying in further elements such as Cu and Al. However, this is only partially successful and is additionally connected with loss of strength characteristics. See, Hoffmann, G., Thümmler, F., Zapf, G. "Sintering, Homogenization and Properties of Alpha-Phase Iron-Aluminum and Iron-Silicon Alloys", ibid.

Mn has also found acceptance as an alloying element in powder metallurgy. Since it likewise has a great affinity for oxygen, special protective measures are required here as well. It is known, for example, to introduce Mn by way of carbidic master alloys. See German Pat. No. 2,456,781, entitled "Method for Producing Homogeneous Manganese Alloyed Sintered Steels." These master alloys are stable up to the range of the sintering temperature so that the alloying elements are protected against oxidation. However, since Mn itself is not a strong carbide former, these master alloys must inevitably contain carbide forming elements, such as, for example, Cr, Mo or V. These elements are very expensive which considerably increases the costs for the alloys. Moreover, the great hardness of the carbides results in increased tool wear.

The combined use of Si and Mn to produce a sintered steel is mentioned in the literature, but no description is provided concerning the procedures to be followed in producing such a sintered steel. Sintered steels produced by the combined use of Si and Mn, moreover, are stated "not to bring any surprising results." See, Findeisen, G., Hewing, J., "Copper and Nickel Containing Sintered Steels Including Further Alloying Additives", Industrie-Anzeiger, Volume 92 (1970), pages 241–244 and 431–434, especially page 434.

SUMMARY OF THE INVENTION

It is an object of the present invention to provide a method for the powder metallurgical production of structural parts of great strength and hardness as well as sufficient toughness from sintered steels, the process employing exclusively easily obtainable alloying elements whose availability is assured for long periods of time.

A further object of the present invention is to provide such a process in which the structural parts which are to be produced retain their dimensions during the sintering process, i.e. due to the addition of alloying elements, the parts will not exhibit shrinkage and/or loss of strength due to shrinkage preventing measures.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, the present invention provides a process for the powder metallurgical production of structural parts of high strength and hardness of silicon-manganese or silicon-manganese-carbon alloyed steels comprising: mixing, in powdered form, the alloying elements silicon and manganese or silicon, manganese and carbon, by way of the alloy carriers ferrosilicon, ferromanganese or a silicon-manganese-iron master alloy having silicon and manganese contents in the ranges from 10 to 30 weight percent Si, 20 to 70 weight percent Mn, and remainder Fe, with an iron powder, and when carbon is present in the steel with graphite, to form a powder mixture, compressing the powder mixture and sintering the resulting compact in a protective gas atmosphere at a temperature in a range from 1150° C. to 1250° C., and then cooling.

The admixture of the alloy carriers and the graphite preferably is effected in such quantities that they correspond to the weight proportions in the powder mixture of:

0.3 to 3 weight percent Si;
0.3 to 4 weight percent Mn;
0 to 0.5 weight percent C.

In a preferred embodiment of the present invention, a weight ratio of manganese to silicon between 1.5 and 3 is employed.

When employing a ferrosilicon, the ferrosilicon preferably contains 15 weight percent Si. When employing a ferromanganese, the ferromanganese preferably contains 80 to 84 weight percent Mn.

When employing a silicon-manganese-iron master alloy, products exhibiting the best mechanical properties are obtained if the silicon-manganese-iron master alloy has a composition of 19 weight percent Si, 41 weight percent Mn, and 40 weight percent Fe.

In another preferred embodiment of the process according to the present invention, the sintered structural parts are subjected to an additional heat treatment including hardening and tempering.

It is to be understood that both the foregoing general description and the following detailed description are exemplary and explanatory, but are not restrictive of the invention.

DETAILED DESCRIPTION OF THE INVENTION

Figure 1:
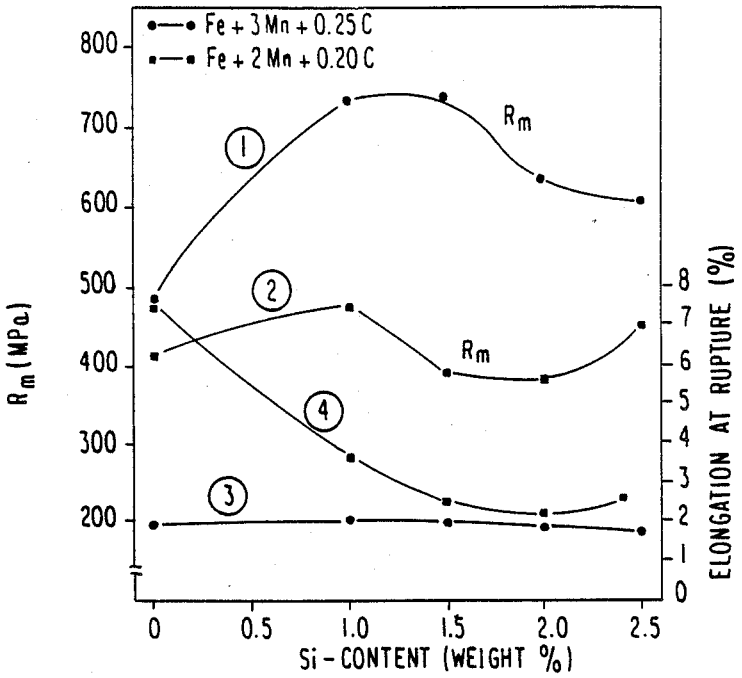
FIGS. 1 to 8 show mechanical characteristics and changes in dimensions for various alloy compositions produced in accordance with the teachings of the present invention.

In the practice of the process of the present invention for producing silicon-manganese or silicon-manganese-carbon alloyed steels, the silicon and manganese contents are provided in powdered form, by way of the alloy carriers ferrosilicon, ferromanganese or a silicon-manganese-iron master alloy having silicon and manganese contents in the ranges from 10 to 30 weight percent Si, 20 to 70 weight percent Mn, and remainder Fe. These alloy carriers are mixed with graphite when the alloyed steel is to contain a carbon and are mixed with an iron powder to form a powder mixture. The powder mixture is compressed, then sintered in a protective gas atmosphere at a temperature in a range from 1150° C. to 1250° C., and then cooled. When the alloyed steel is to contain carbon, the carbon is incorporated in the powder mixture in the form of graphite, preferably in an amount of 0.01 to 0.5 weight percent C, most preferably 0.1 to 0.5 weight percent C. Si preferably is incorporated in the powder in an amount of 0.3 to 3 weight percent Si, and Mn preferably is incorporated in the powder mixture in an amount of 0.3 to 4 weight percent Mn.

With sufficiently high cooling rates from the sintering temperature, great strength and hardness are realized in the practice of the present invention with the single-sinter process.

The process according to the present invention produces the following results:

(a) sintering and homogenization are not adversely affected by oxidation of the alloying elements;

(b) homogeneous distribution of the alloying elements is realized with sintering temperature and time conditions that are relevant for industrial application;

(c) the alloying elements effectively result in an increase in strength;

(d) the finished parts change their dimensions as little as possible during sintering.

During the homogenization, a temporarily liquid phase appears already at temperatures around about 1000° C., so that oxide layers possibly present on the alloying particles cannot become a diffusion barrier and additionally the alloying elements are distributed rapidly. The addition of Mn and C results in a compensation of the shrinkage previously caused by Si, so that as a whole, only relatively slight changes in dimensions or in dimension retention result. Further, Si and Mn act as solid solution hardeners. Moreover, Mn lowers the transformation temperature, and Si influences the C diffusion so that the combination of the alloying elements Si-Mn-(C) results in high strength values. A tempered structure having a hardness up to 300 HV 20 can be realized with furnace cooling at an average cooling rate of 30°K/min from the sintering heat, i.e. without additional heat treatment. With sufficiently slow cooling, however, a hardening effect can be suppressed, so that sizing of the bodies is possible. Moreover, further benefits can be obtained from the use of the alloying elements employed by subjecting the sintered structural parts to additional heat treatment.

The resulting advantages of the alloys employed in the present invention are:

(a) Low alloying costs compared to conventionally alloyed sintered steels and high tensile strengths (>600 MPa). Only a few of the known, relatively highly alloyed compositons reach tensile strengths of 700 MPa with the single-sinter process without additional heat treatment (e.g. sintered steel containing 4.5% Cu, 5% Ni:tensile strength ($R_m$)=600 MPa).

(b) In a sintering temperature range from 1150° to 1250° C. the mechanical characteristics are relatively insensitive to the sintering temperature. This makes possible, for example, accurate compensation of changes in dimensions by selection of a suitable sintering temperature without greatly changing the mechanical behavior.

(c) The presence of Si and Mn results in such an increase in hardenability that a tempered structure is produced already during cooling from the sintering heat so that further heat treatment becomes unnecessary. Such sintered steels have previously been produced with the use of the expensive alloying elements Ni and Mo.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE 1

Different quantities of Si, Mn and C were added, by way of the above-mentioned alloy carriers (ferrosilicon, ferromanganese, graphite), to a conventional iron powder and were mixed together with a conventional press facilitating additive. The powder mixture was pressed into test rods at a compacting pressure of 600 MPa, and these rods were sintered in a hydrogen atmosphere for 60 minutes at a temperature of 1180° C.

Figure 2:
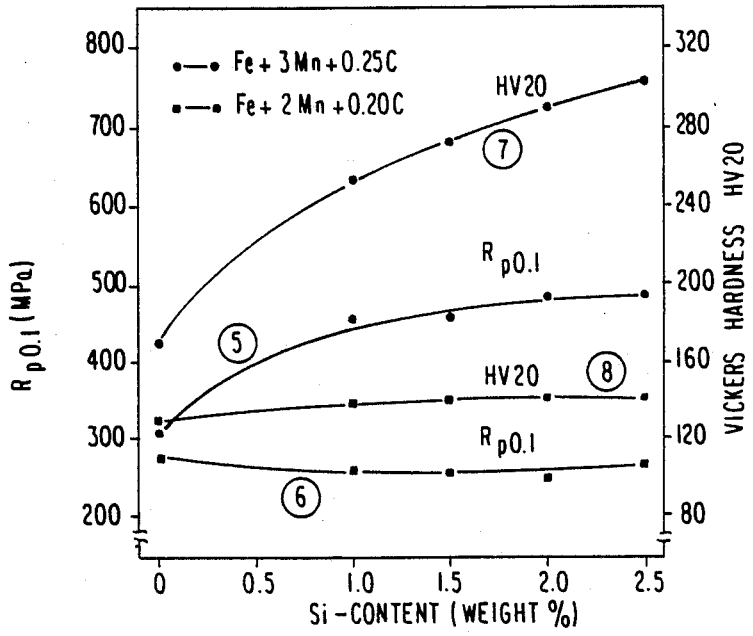

The mechanical characteristics of several selected compositions are shown in FIGS. 1 and 2. In particular, the mechanical characteristics of compositions based on Fe3Mn+0.25 C and containing varying amounts of Si, namely, 0, 1.0, 1.5, 2.0 and 2.5 weight % Si, are shown in Curves 1 and 3 of FIG. 1, and Curves 5 and 7 of FIG. 2. (In formulas, such as Fe+3 Mn+0.25 C+varying amounts of Si, the numbers before each element other than Fe indicate the weight percentage of that element in the composition, with Fe being the balance of the composition.)

In addition, the mechanical charcteristics of compositions based on Fe+2 Mn+0.20 C and containing varying amounts of Si, namely, 0, 1.0, 1.5, 2.0 and 2.5 weight % Si, are shown in Curves 2 and 4 of FIG. 1 and Curves 6 and 8 of FIG. 2.

The tensile strength ($R_m$) in MPa of the alloys in dependence of their silicon content, is shown in Curve 1 for the compositions based on Fe+3 Mn+0.20 C, and in Curve 2 for the compositions based on Fe+2 Mn+0.20 C..

The elongation at ruptue (A) in dependence on silicon content is shown in Curve 3 for the compositions based on Fe+3 Mn+0.25 C, and in curve 4 for the compositions based on Fe+2 Mn+0.20 C.

The permanent elongation load ($R_{p0.1}$) in MPa of the alloys in dependence on silicon content is shown in Curve 5 for the compositons based on Fe+3 Mn+0.25 C, and in Curve 6 for the compositions based on Fe+2 Mn+0.20 C.

The hardness values (Vickers hardness HV 20) of the alloys in dependence on silicon content is shown in Curve 7 for the compositons based on Fe+3 Mn+0.25 C, and in Curve 8 for the compositions based on Fe+2 Mn+0.20 C.

Optimum combinations of characteristics were realized with weight proportions of 1 to 2 weight percent Si, 2 to 3 weight percent Mn, and 0.2 to 0.3 weight percent C.

Figure 3:
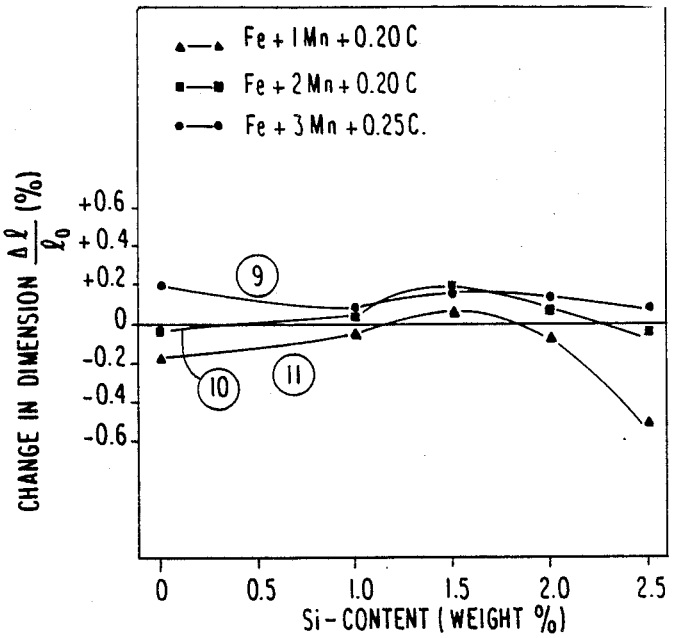

The changes in length of the test rods as a result of sintering are shown in Curves 9 to 11 of FIG. 3 for compositions based on Fe+3 Mn+0.25 C.

In particular, changes in dimensions ($\Delta l/l_0$ where l represents length and $l_0$ represents original length) of various alloys in dependence on silicon content is shown in Curve 9 for the compositions based on Fe+3 Mn+0.25 C, in Curve 10 for compositions based on Fe+2 Mn+0.20 C, and in Curve 11 for compositions based on Fe+1 Mn+0.20 C.

As can be seen from FIG. 3, only with a ratio of Si/Mn>2 does the shrinkage increase considerably.

A second series of test rods were produced with the same Si and Mn contents, but without carbon, and in the second series there were realized tensile strengths of 350 to 600 MPa, hardnesses from 100 to 210 HV 20, and elongations at rupture of 11 to 2%. Under the stated manufacturing conditions, the alloys of the second series also have stable dimensions within certain ranges (e.g. 2% Si, 2 to 4% Mn).

EXAMPLE 2

With a composition providing the optimum combination of characteristics, namely, a composition of Fe+1 Si+3 Mn+0.25 C, the sintering temperature was varied, with the other manufacturing conditions remaining the same as in Example 1. Mechanical characteristics and changes in dimensions as a result of the different sintering temperatures are shown in FIGS. 4 and 5.

Figure 4:
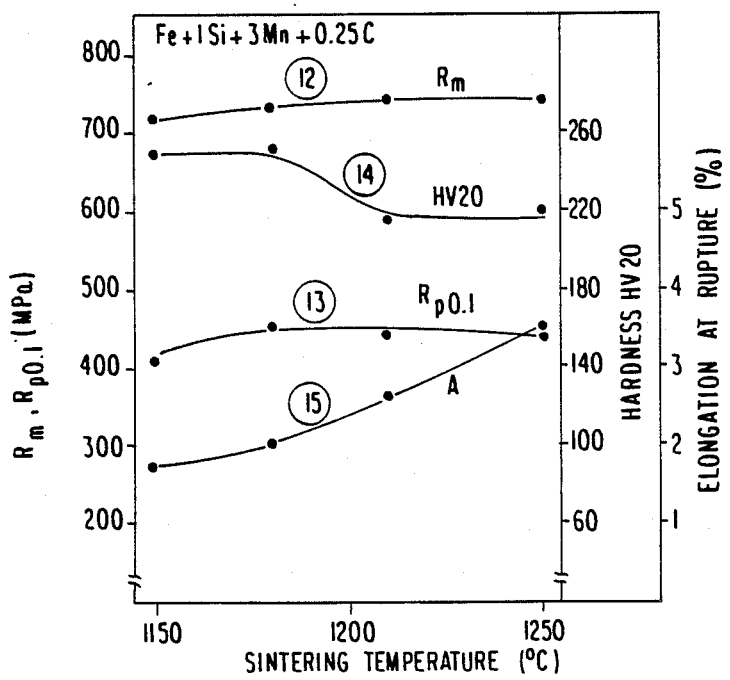

In particular, FIG. 4 shows the tensile strength in Curve 12, the permanent elongation loads in Curve 13, the hardness value in Curve 14, and elongation at rupture in Curve 15, of one and the same alloy (Fe+1 Si+Mn+0.25 C) in dependence on the sintering temperature employed during manufacture.

Figure 5:
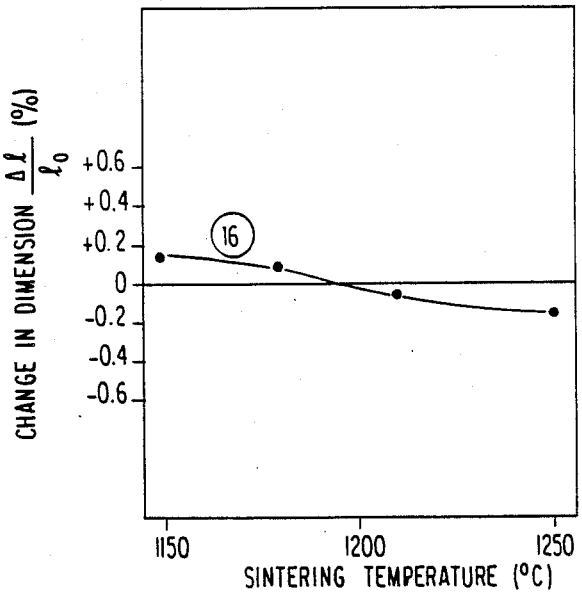

FIG. 5 shows the changes in dimensions in Curve 16 in one and the same alloy (Fe+1 Si+3 Mn+0.25 C) in dependence on the sintering temperature employed during manufacture.

As can be seen from FIG. 4, tensile strength (Curve 12) and permanent elongation loads (Curve 13) in the sintering ranges under examination are almost independent of the sintering temperature. As can be seen in FIG. 4, hardness (Curve 14) and elongation at rupture (Curve 15) also so not change substantially with sintering temperature.

As can be seen in FIG. 5, with increasing sintering temperature, the initially occurring slight swelling regresses until even a slight amount of shrinkage occurs. This opens up the possibility of adjusting the dimensional behavior by way of the sintering temperature, without significantly changing the mechanical characteristics ($R_m$=tensile strength in MPa; $R_{p0.1}$=permanent elongation load in MPa; A=elongation at rupture in %).

EXAMPLE 3

For parts requiring sizing, very slowly conducted cooling from the sintering heat is necessary. Strength and hardness then do not reach the values shown in Examples 1 and 2. The alloying elements employed, however, permit subsequent heat treatment.

Figure 6:
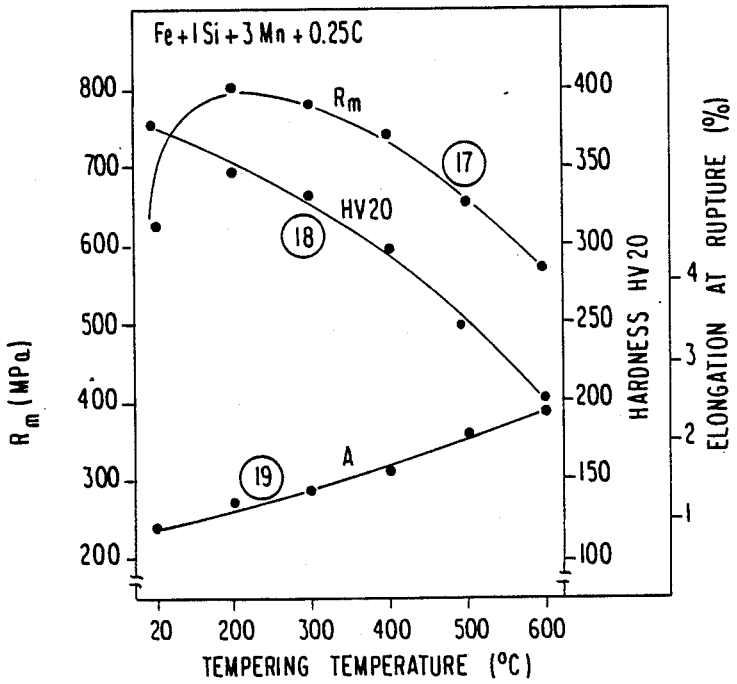

The alloy used in Example 2 was sintered in hydrogen for 60 minutes at 1200° C. and subsequently tempered. The tempering treatment comprised austenizing at 1000° C. for 60 minutes in argon, quenching in oil, and tempering for 60 minutes in argon at the stated temperatures illustrated in FIG. 6. FIG. 6 illustrates the changes in various mechanical properties as a result of varying the tempering temperature, with Curve 17 showing tensile strengths, Curve 18 showing hardness values and Curve 19 showing elongation at rupture of one and the same alloy (Fe+1 Si+3 Mn+0.25 C). As can be seen from FIG. 6, optimum strength and hardness values are realized at tempering temperatures of from 200° to 300° C., and elongation at rupture is still measurable and greater than 1%.

EXAMPLE 4

This example illustrates the manufacture of alloys using an Si-Mn-Fe master alloy master alloy.

Initially, a master alloy of the following composition was
produced:

19 weight percent Si
41 weight percent Mn
40 weight percent Fe

The master alloy was melted in a vacuum furnace and, after cooling, mechanically comminuted to a particle size less than 25 microns (average particle size about 10 microns). The comminution may take place in a breaker, in a vibrating disc mill or in a ball mill.

Different quantities of the master alloy produced in this manner were mixed, either without the addition of carbon or with the addition of carbon in the form of graphite, with iron powder mixtures, and processed in the conventional manner. A compacting pressure of 600 MPa, a sintering temperature of 1180° C., a sintering time of one hour and a hydrogen atmosphere as the protective gas atmosphere were employed.

Figure 7:
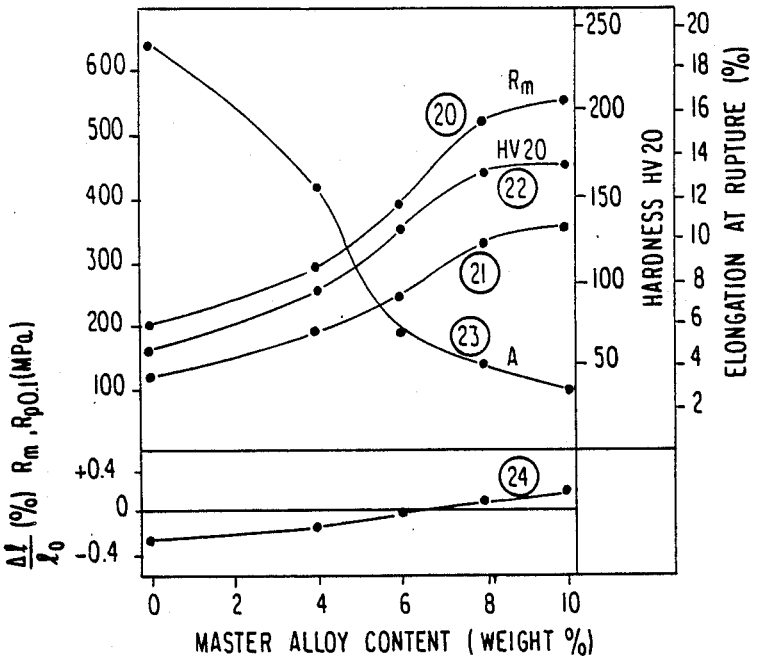

The mechanical characteristics and the changes in dimensions of the silicon-manganese alloyed sintered steels are shown in FIG. 7 as a function of the master alloy content which varied from 0, 4, 6, 8 and 10 weight percent.

In particular, FIG. 7 shows the tensile strengths ($R_m$) in Curve 20, the permanent elongation loads ($R_{p0.1}$) in Curve 21, the hardness values (HV 20) in Curve 22, the elongation at rupture (A) in Curve 23, and the changes in dimension ($\Delta l/l_0$) in Curve 24, of various Si-Mn alloyed sintered steels, without the addition of C, in dependence on the amount of master alloy (19 Si - 41 Mn - 40 Fe) in the powder mixture to be sintered.

FIG. 7 shows that the optimum amount of the master alloy in the sintered steel alloy is about 8 weight percent (i.e., manganese and silicon contents in the sintered steel alloy of 3.3 weight percent manganese and 1.5 weight percent silicon).

Figure 8:
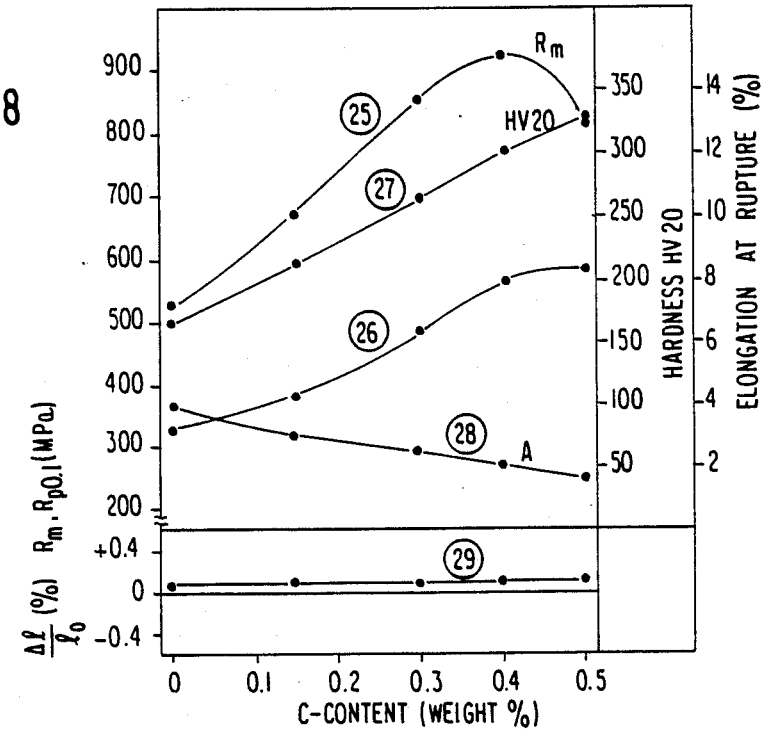

FIG. 8 shows the influence of different carbon contents on the mechanical properties and the changes in dimension of the silicon-manganese-carbon alloyed steel which exhibited the optimum properties in FIG. 7, that is, the optimum alloy containing 8 weight percent master alloy in the sintered steel.

In particular, FIG. 8 shows the tensile strength in Curve 25, the permanent elongation loads in Curve 26, the hardness values in Curve 27, the elongation at rupture in Curve 28, and the changes in dimensions in Curve 29, of the sintered steels containing 8 weight percent of the master alloy (19 Si - 41 Mn -40 Fe) in dependence on their C content.

As shown in FIGS. 7 and 8, Si-Mn-Fe master alloys resulted in sintered steels that had excellent combinations of properties. By employing an Si-Mn-Fe master alloy, tensile strengths and permanent elongation loads can be realized which are even higher than those of the sintered steels produced with the use of ferrosilicon and ferromanganese as the alloy carriers.

Possibly, further improvements can be realized in the sintered steels according to the present invention by use of a double-sinter process and/or if the final heat treatment is optimized.

The better characteristics which are achieved by employing the Si-Mn-Fe master alloy are a result of:

(a) better compactibility of the powder mixtures containing the master alloy, resulting in less porosity of the bodies;

(b) very uniform distribution of the alloying elements, since the alloy carriers are present as very fine particles;

(c) uniform sintering behavior of the alloy carriers due to their unchanging composition.

When employing the Si-Mn-Fe master alloy stability of dimensions can be realized by suitable settings of composition and sintering temperature.

During the sintering process, the Si-Mn-Fe master alloy having the stated ranges of 10 to 30 weight percent for silicon and 20 to 70 weight percent for manganese, also results, within the stated range of the technological sintering temperatures of 1150° C. to 1250° C., in the formation of a liquid phase which is coresponsible for the significant improvement in the characteristics of the sintered steels produced according to the present invention. Lower manganese and silicon contents require too large an amount of the master alloy to attain optimum alloy contents. In particular, too large an amount of the master alloy makes the powder mixtures less compactible, resulting in a drop in density. On the other hand, higher manganese and silicon contents, particularly silicon, no longer lead to the formation of a liquid phase in the range of sintering temperatures up to about 1250° C.

The advantages brought about by the Si-Mn-Fe master alloys employed in the present invention are as follows:

They are relatively easy to produce, their melting temperature is relatively low, and they are obtained as cast blocks which are extremely brittle and therefore very easy to mechanically comminute to a very fine consistency. Sintering behavior becomes more favorable with the use of Si-Mn-Fe master alloys.

It will be understood that the above description of the present invention is susceptible to various modifications, changes and adaptations, and the same are intended to be comprehended within the meaning and range of equivalents of the appended claims.

What is claimed is:

1. Process for the powder metallurgical production of structural parts of the high strength and hardness of silicon-manganese or silicon-manganese-carbon alloyed steels, comprising: mixing, in powdered form the alloying elements silicon and manganese or silicon, manganese and carbon by way of a silicon-manganese-iron master alloy having silicon and manganese contents in the ranges from 10 to 30 weight percent Si, 20 to 70 weight percent Mn, remainder Fe, with an iron powder, and when carbon is present in the steel with graphite, to form a powder mixture consisting essentially of iron powder with the Fe content in the powder mixture being present in an amount of at least 92.5 weight percent, compressing the powder mixture and sintering the resulting compact in a protective gas atmosphere at a temperature in a range of 1150° or 1250° C. to form a liquid phase, and then cooling.

2. Process as defined in claim 1, wherein the admixture of the master alloy and of the graphite is effected in such quantities that they correspond to the weight proportions in the powder mixture of 0.3 to 3 weight percent Si,
0.3 to 4 weight percent Mn,
0 to 0.5 weight percent C.

3. Process as defined in claim 1, wherein a silicon-manganese-iron master alloy is employed which has the following composition:

19 weight percent Si,
41 weight percent Mn,
40 weight percent Fe.

4. Process as defined in claim 1, wherein the sintered structural parts are subjected to an additional heat treatment, including hardening and tempering.

5. Process as defined in claim 1, wherein the admixture of the master alloy and of the graphite is effected in such quantities that they correspond to the weight proportions in the powder mixture of 0.3 to 3 weight percent Si,
0.3 to 4 weight percent Mn,
0.01 to 0.5 weight percent C.

6. Process as defined in claim 1, wherein the admixture of the master and of the graphite is effected in such quantities that they correspond to the weight proportions in the powder mixture of 0.3 to 3 weight percent Si,
0.3 to 4 weight percent Mn,
0.1 to 0.5 weight percent C.

7. Process as defined in claim 1, wherein a weight ratio of manganese to silicon between 1.5 and 3 is employed.

* * * * *